US005362053A

United States Patent [19]

Miller

[11] Patent Number: 5,362,053

[45] **Date of Patent: * Nov. 8, 1994**

[54] CARD READER FOR BLACKJACK TABLE

[75] Inventor: Arthur Miller, Las Vegas, Nev.

[73] Assignee: Tech Art, Inc., Las Vegas, Nev.

[ * ] Notice: The portion of the term of this patent subsequent to Aug. 13, 2008 has been disclaimed.

[21] Appl. No.: 98,421

[22] Filed: Jul. 27, 1993

Related U.S. Application Data

[63] Continuation-in-part of Ser. No. 709,363, May 31, 1991, Pat. No. 5,312,104, which is a continuation-in-part of Ser. No. 446,205, Dec. 4, 1989, Pat. No. 5,039,102.

[51] Int. Cl.[5] ..... A63F 1/06

[52] U.S. Cl. ..... 273/148 R; 273/309; 273/304

[58] Field of Search ..... 273/148 R, 148 A, 149 R, 273/149 P, 138 R, 138 A, 85 CP, 292, 293, 296, 303, 304, 305, 309; 108/23

[56] References Cited

U.S. PATENT DOCUMENTS

| | | |
|---|---|---|
| D. 317,951 | 7/1991 | Miller . |
| 1,590,463 | 6/1926 | Wood . |
| 1,919,922 | 7/1933 | Baker, Jr. et al. . |
| 2,046,595 | 7/1936 | Yerkes . |
| 3,034,512 | 5/1962 | Hunter . |
| 3,165,319 | 1/1965 | Benima . |
| 3,222,071 | 12/1965 | Lang . |
| 3,312,473 | 4/1967 | Friedman et al. . |
| 3,489,907 | 1/1970 | Kenez . |
| 3,529,829 | 9/1970 | Seifert . |
| 3,658,342 | 4/1972 | Boren . |
| 3,690,670 | 9/1972 | Cassady et al. . |
| 3,716,238 | 2/1973 | Porter . |
| 3,731,936 | 5/1973 | Copeland . |
| 3,742,616 | 7/1973 | Heller . |
| 3,743,294 | 7/1973 | Forster . |
| 3,751,041 | 8/1973 | Seifert . |
| 3,779,554 | 12/1973 | Brix . |
| 3,814,436 | 6/1974 | Boren . |
| 3,858,797 | 1/1975 | Takeuchi . |
| 4,146,229 | 3/1979 | Morse . |
| 4,314,700 | 2/1982 | Dylag . |
| 4,534,562 | 8/1985 | Cuff et al. . |
| 4,822,050 | 4/1989 | Normand et al. . |
| 5,039,102 | 8/1991 | Miller . |
| 5,067,713 | 11/1991 | Soules et al. . |
| 5,110,134 | 5/1992 | Laughlin et al. . |
| 5,219,172 | 6/1993 | Laughlin et al. ..... 273/148 R |
| 5,224,712 | 7/1993 | Laughlin et al. ..... 273/148 R |

FOREIGN PATENT DOCUMENTS

| | | |
|---|---|---|
| 0310516 | 4/1989 | European Pat. Off. . |
| 2109213 | 5/1972 | France . |
| 2186839 | 1/1974 | France . |
| 2427107 | 12/1979 | France . |
| 2576518 | 8/1986 | France . |
| 1039429 | 9/1958 | Germany . |
| 3807127 | 9/1989 | Germany . |

*Primary Examiner*—Jessica J. Harrison
*Attorney, Agent, or Firm*—Malin, Haley, DiMaggio & Crosby

[57] ABSTRACT

A device for speeding the pace of a game of blackjack is provided. The device is comprised of a housing having a top surface and an upper planar portion. The top surface will be connected on top to the upper planar portion. A card reader for reading a corner of a specialized playing card is located within the housing. An indicator cooperating with the card reader is provided to inform the dealer if his down card is of a desired value. A magnetic sensor, optic sensor, bar code and decoder, video camera, reflective element, refractive element or the like are disclosed for allowing the dealer to determine the value of the down card. There is also disclosed herein a method for increasing the speed of play in an organized game of blackjack.

13 Claims, 8 Drawing Sheets

CARD READER FOR BLACKJACK TABLE

This application is a continuation-in-part of co-pending application Ser. No. 07/709,363, filed May 31, 1991, now U.S. Pat. No. 5,312,104, which application is a continuation-in-part of application Ser. No. 07/446,205, filed Dec. 4, 1989, which application issued Aug. 13, 1991 as U.S. Pat. No. 5,039,102.

BACKGROUND OF THE INVENTION

1. Field of the Invention

The instant invention relates to an apparatus for reading playing cards and more particularly relates to a device for reading a corner of a playing card while the playing card is face down on a gaming table.

2. Description of the Prior Art

The business of a modern gambling casino requires careful attention to efficiency and accuracy to enhance the fairness of play and the profitability of the various tables. Not only is the speed of play deemed critical by the individual casinos, but most players prefer, and in fact demand, a rapid pace of play. Further, the element of fairness is of utmost importance to both casino owner and player alike.

In the game of blackjack, a time consuming delay arises when the dealer's up card, that is his exposed card, has a value of ten, and his down card is an Ace. Another time consuming delay occurs when the dealer's up card is an Ace, and his down card has a value of ten. In either case the dealer will first play out the hand with the players at the table and, after dealing the last player, will expose his down card. If his down card is an Ace and his face up card has a value of ten or if his down card has a value of ten and his face-up card is an Ace, the dealer has twenty-one and automatically wins. When this condition is present, the time spent dealing to players is essentially wasted. If the value of the down card held by the dealer could have been ascertained without breaching the necessary level of security at the table, the time consumed in dealing out to the remaining players after the dealer had earlier obtained twenty-one could have been avoided and a new hand commenced. Throughout the course of play, the unnecessary delays resulting from this occurrence accumulate to a substantial amount of time, which can be avoided if it can be determined early when the dealer is dealt twenty-one.

However, because casinos now forbid dealers to look at their down cards during a game of twenty-one for security reasons, dealers presently have no way of determining if they have twenty-one until all players have played out the hand. That is, the exposure of any card not intended to be seen by anyone but the dealer imposes a risk to the security of the hand. Further, a dealer, if so inclined, can easily cheat by looking at his down card and providing a surreptitious signal to a cohort player.

When weighed in light of the desirability of ascertaining whether the dealer has blackjack when his or her up card is an Ace or has the value of ten, some means are required to speed up play in a manner that is both fair to the players and of low risk to the casino.

SUMMARY OF THE INVENTION

It is a principal object of the instant invention to provide an apparatus for reading indicia or other readable media from a portion of playing card in a game of blackjack.

It is also an object of the present invention to provide an apparatus and method for speeding up the play in organized blackjack in a fair and secure manner.

It is a further object of the present invention to provide a method of reading specialized indicia or other readable media from a playing card in a game of blackjack.

These and other objects are obtained by the instant invention, which is comprised generally of a card reading means for electronically or visually reading a portion of a playing card placed thereover, and an appropriate means for indicating the presence of certain values of cards in association with said means for reading. Preferably, the means for reading is connected to a planar top panel which in turn is connected to a housing for the invention. The planar top panel is adapted to be disposed in co-planar relationship with the playing surface of the blackjack table.

In a first embodiment the instant invention is comprised of a card reading device for electronically sensing, or reading, a portion of playing cards placed thereover, an energy source and an indicating device associated with a housing. The energy source is used to energize the indicating device when the dealer has obtained blackjack. The housing includes a smooth top panel, co-planar with the top surface of the table, for placing a playing card face down thereon to be read. A card receiving device may be attached to the top panel for receiving a corner of the card to be read. The card reading device senses the presence of certain value cards and ignores others and sends an indicating signal to the indicating device.

In a second embodiment a light source replaces the energy source of the first embodiment, and a reflective surface for allowing the dealer to observe a portion of the playing cards passed thereover is substituted for the device for electronically reading cards. The top panel is provided with an aperture disposed generally below and partially covered by the card receiving device and aligned generally vertically above the card reading device.

In a third embodiment, a camera and monitor replace the card reading device and indicating device of the first embodiment. The camera records an image of the corner of the card and transfers the image to a monitor to be viewed by the dealer.

In a fourth embodiment, a refractive device replaces the reflective device of the second embodiment. The refractive device refracts the image of the corner of the card towards the dealer.

The instant invention will be used in conjunction with a deck of cards having a unique marking system. In a typical deck of playing cards, indicia (e.g. 5, 7, Q, A) are disposed in only the upper left hand and lower right hand corners. In the specialty deck contemplated for use with the instant invention the upper left hand indicia on each card is lowered down the left side of the playing card away from the upper left hand corner. In addition, the indicia is raised up the right side of each playing card away from the lower right hand corner. Also in the specialty deck, additional indicia to be read by the reading device is disposed on only the Ace cards in the upper right and lower left hand corners. Finally, a marking or other readable media is disposed on the upper left hand and lower right hand corners of all cards having a value of ten.

In operation, if the dealer's up card has a value of ten, he will place his down card face down on the top panel of the instant invention and then insert either the upper right or lower left hand corner of his down card, when viewed from the perspective of the playing face of the card, into the card receiving device to be read by the card reading device. If the inserted card is an Ace, the indicating device will so inform the dealer and it will become immediately known, before playing out the remainder of hand with the players at the table, that the dealer has won. Alternatively, if the dealer's up card is an Ace, he will place his down card face down on the top surface and then insert either the upper left or lower right hand corner of his down card, when viewed from the perspective of the playing face of the card, into the card receiving device to be read by the card reading device, If the inserted card has a value of ten, the indicating device will indicate that the dealer has won.

A further aspect of the invention lays in the method for increasing the speed of play of the game of blackjack in a fair and secure manner comprising the steps of dealing a hand of blackjack to a plurality of players, including the dealer, and if the dealer's upfacing card has a value of ten or is an Ace, ascertaining whether the dealer's down card is an Ace or has a value of ten, and if said down card is an Ace or a ten value card, terminating the hand or, alternatively, if said down card is other than an Ace or ten value card, continuing to play.

Having thus described the instant invention, particular reference will now be made to the detailed description of the invention where like elements are referred to by like numerals.

DETAILED DESCRIPTION OF THE PREFERRED EMBODIMENT

Figure 1A:
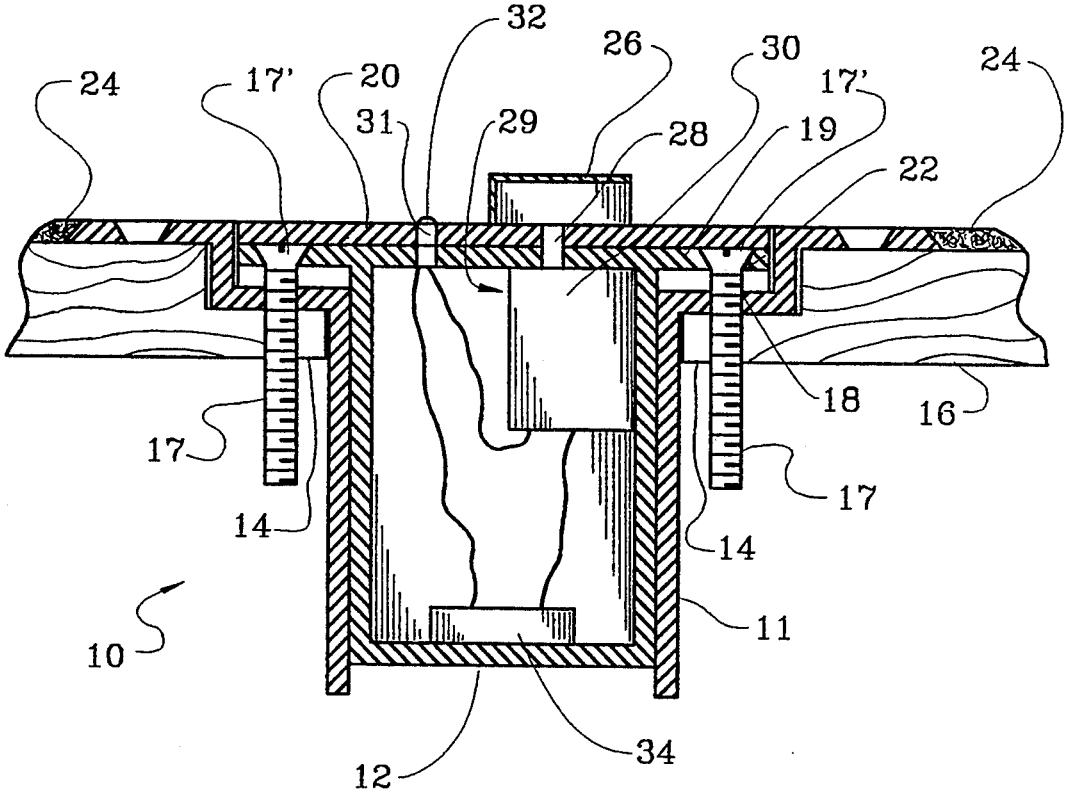
FIG. 1A shows a sectional view of a first embodiment of the instant invention mounted to a blackjack table.

Referring now to the drawings, FIG. 1A shows the instant invention generally designated by the reference numeral 10 comprised of a housing 12 adapted to be connected in a recess 14 of a case 11 by conventional attachment means, such as by threaded bolts 17 passed through apertures 18 of recess 14. Case 11 is adapted to be connected to a conventional blackjack casino table 16 by conventional attachment means (not shown), such as by countersunk screws (not shown) passed through apertures 13 defined by the horizontal upper surface of case 11. Housing 12 is comprised generally of a hollow rectangular member which may be integrally connected to an upper planar member 19. Member 19 is adapted to receive a top surface panel 20 connected to upper planar member 19 in co-planar association. A card receiving device 26 is connected to panel 20.

As it is preferred that top panel 20 form a smooth continuous surface with the top surface material 24 of blackjack table 16 so as not to mar any of the playing cards which will come into contact therewith, the connection of top panel 20 with member 19 should be concealed. To this end, threaded bolts 17 are passed through apertures 22 in member 19 and downwardly through corresponding apertures 18 defined by recess 14 of case 11. Top panel 20 may then be laminated to member 19 to conceal the heads 17' of bolts 17. The invention 10 disclosed herein is intended to fit in generally co-planar arrangement with the covering material 24 of conventional blackjack table 16.

As seen in FIG. 1A, a means for reading a portion of a playing card comprising a card reading device, generally designated by the reference numeral 29, will include sensor 30 and sensor lens 28. Sensor 30 may be either magnetic or optic. An indicator light 32 associated with panel 20, through aperture 31, along with a power source 34, is connected in series with sensor 30. Alternatively, an electronic bar code scanner receiver and decoder may be substituted for sensor 30 and sensor lens 28. Further in the alternative, an electronic circuit breaker/receiver and circuit element source may be utilized as the card reading device 29. If the dealer's down card is of a predetermined value, for example an ace where the dealer's up card is a ten value card, the insertion of a corner of the down card will break the circuit. This break in circuit will close a switch (not shown) which will in turn supply power to indicator light 32. Power source 34 may be a battery located inside housing 12 or may be an external power source fed through an opening (not shown) in the bottom of housing 12.

Figure 2A:
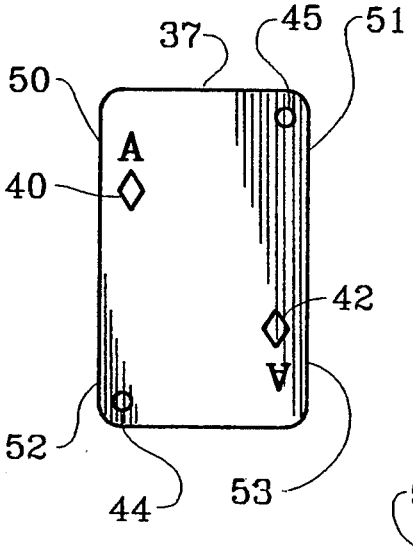
FIG. 2A shows the face side of an Ace card contemplated for use with the instant invention.
Figure 2C:
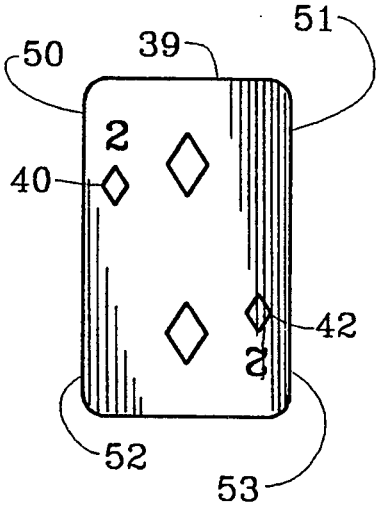
FIG. 2C shows the face side of a representative playing card other than an Ace card or ten value card contemplated for use with the instant invention.
Figure 2B:
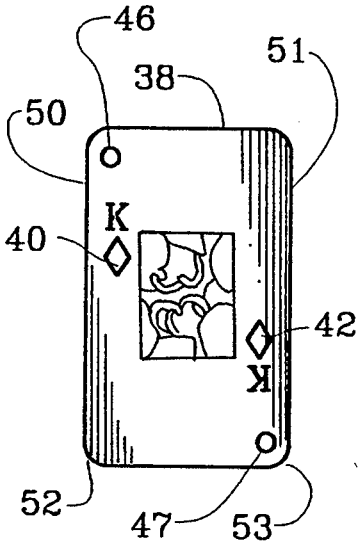
FIG. 2B shows the face side of a representative ten value card contemplated for use with the instant invention.
Figure 6:
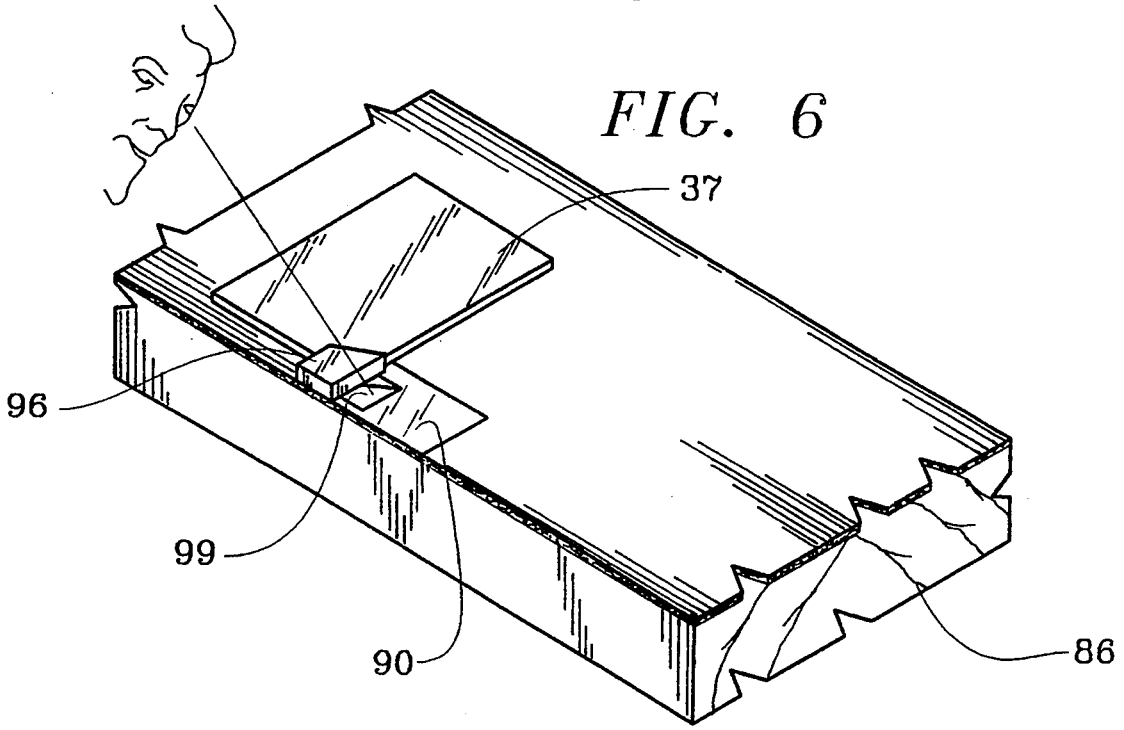
FIG. 6 shows the second embodiment of the instant invention being used to read a face down playing card on a typical blackjack table.

An ace card 37, ten value card 38 and a card other than an ace or ten value are shown in FIGS. 2A, 2B and 2C respectively. In the special deck of cards contemplated to be used with the instant invention, all 52 cards will be of one of the type of cards shown in FIGS. 2A, 2B, and 2C. As seen in FIGS. 2A, 2B and 2C, left hand indicia 40 has been lowered down the left side of cards 37, 38 and 39 and away from upper left hand corner 50. In addition, right hand indicia 42 has been raised up the right side of cards 37, 38 and 39 and away from lower right hand corner 53. As shown in FIG. 2A, ace card 37, as well as the remaining ace cards (A-hearts, A-clover, A-spade not shown) will have an additional indicia 44 and 45 in their lower left hand corner 52 and upper right hand corner 51, respectively. Indicia 44 and 45 will not be present on any of the remaining cards in the special deck. As shown in FIG. 2B, ten value card 38 as well as the remaining ten value cards (not shown) will have an additional indicia 46 and 47 in their upper left hand corner 50 and lower right hand corner 53 respectively. Indicia 46 and 47 will not be present on any of the remaining cards in the special deck. FIG. 2*c* shows a card 39 which represents any card in the special deck other than an ace or a ten value card. As seen in FIG. 2*c*, no indicia are present in any corner of card 39.

The embodiment used for card reading device 29 dictates the type of material used for items 44, 45, 46 and 47. When a magnetic sensor is used items 44, 45, 46 and 47 will be partially or totally ferromagnetic material. When an optic sensor is utilized items 44, 45, 46 and 47 will be made out of dark ink. When a bar code and decoder are used items 44, 45, 46 and 47 can be a single bar or a plurality of bars.

Figure 1B:
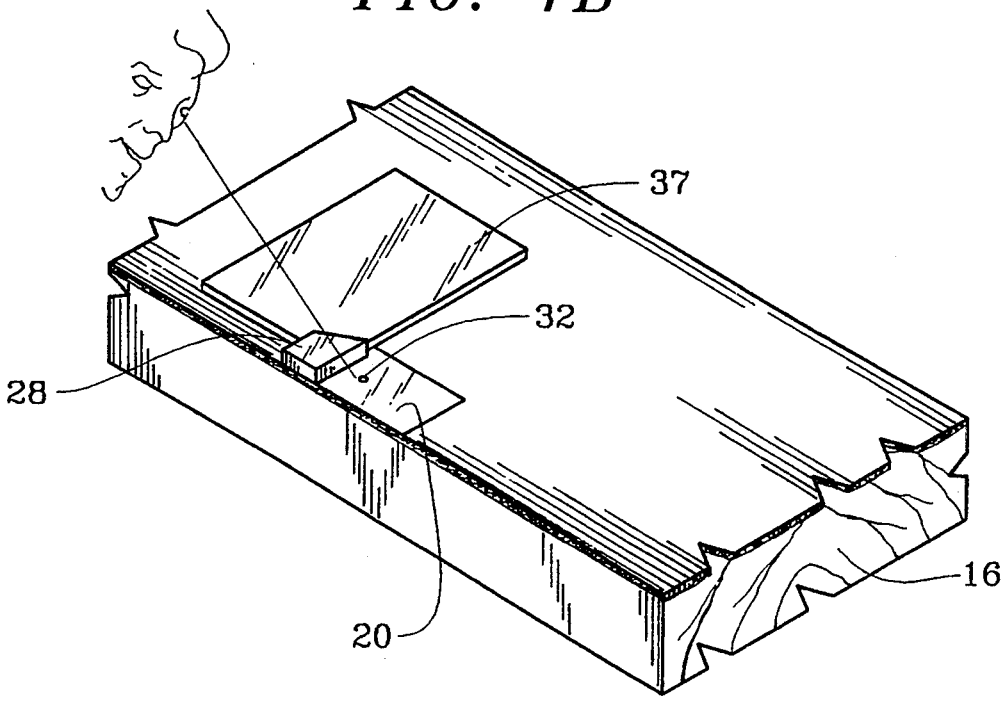
FIG. 1B is a perspective view of the first embodiment of the invention in use searching for an ace.

In operation, if the dealer's up card has a value of ten, the dealer will like to know if his down card is an ace. Therefore, he will place his down card face down on top surface 20 and then insert either the upper right hand corner 51 or lower left hand corner 52 of his down card, when viewed from the perspective of the playing face of the card, into card receiving means 26, as shown in FIG. 1B. Card receiving means 26 is connected to top surface 20 at a position which allows the inserted corner of the down card to be read by sensor or decoder 30 to determine if the down card is an ace.

As seen in FIG. 1A, the card receiving device 26 is a hood. However, card receiving device 26 is not limited to a hood and can be of any device which will position the face of the inserted corner over a sensor or decoder 30. The hood may have two vertical side walls. If the down card is an ace (such as card 37 in FIG. 2A), either marking 44 or 45 will be read, depending on whether upper right hand corner 51 or lower left hand corner 52 of the card, when viewed from the perspective of the playing face of the card, is inserted into card receiving means 26. Once marking 44 or 45 is read a closed circuit will be established between sensor 30, indicator light 32 and power source 34, thus allowing power source 34 to turn on light 32. Once light 32 has been turned on, the dealer will know that his down card is an ace and that he has "21" and has automatically won. Therefore, the hand does not have to continue on. Once the down card has been removed from card receiving means 26, the circuit will once again be open, thereby preventing power source 34 from energizing light 32. Accordingly, light 32 is normally off. Additionally, had the down card not been an ace, then no marking would have been read and light 32 would never have been turned on. If light 32 does not go on the game will continue on.

Figure 1C:
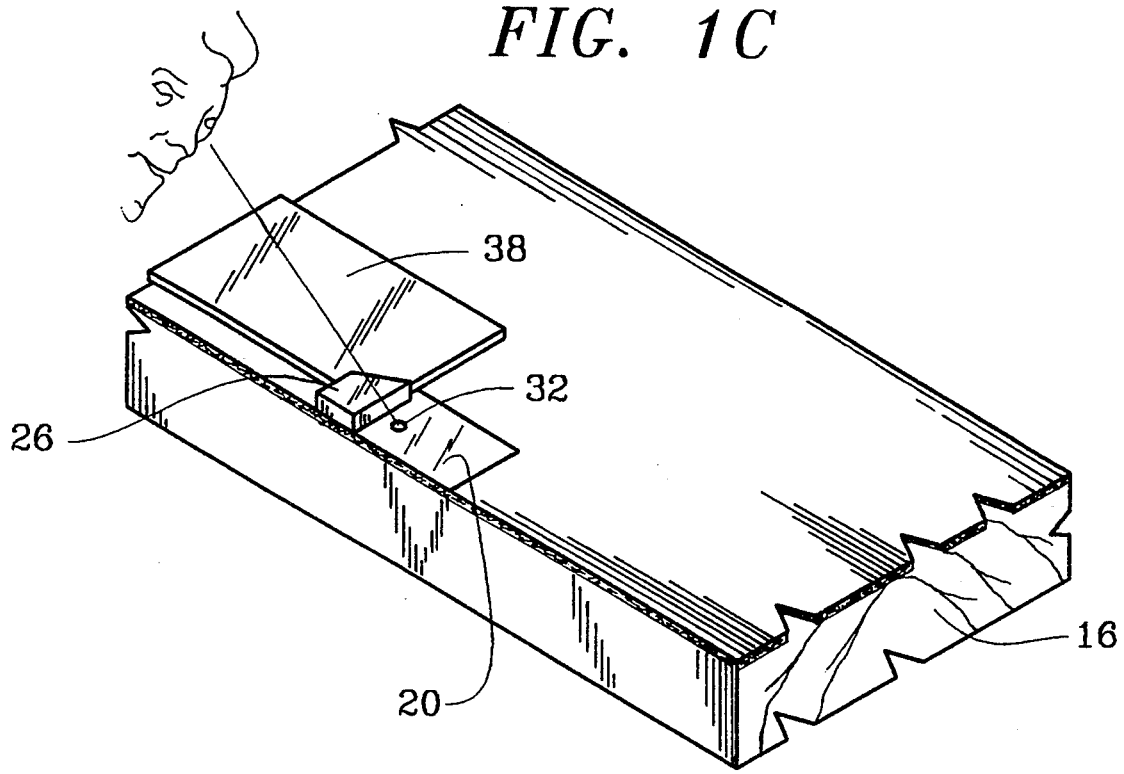
FIG. 1C is a perspective view of the first embodiment of the invention in use searching for a 10 value card.

Alternatively, if the dealer's up card is an ace, he will want to know if his down card has a value of ten (e.g. 10, J, Q, K). Therefore, he will place his down card face down on top surface 20 and then insert either the upper left hand corner 50 or lower right hand corner 53 of his down card, when viewed from the perspective of the playing face of the card, into card receiving means 26, a shown in FIG. 1C. If the down card has a value of ten (such as card 38 of FIG. 2B) either item 46 or 47 will be read, depending on whether upper left hand corner 50 or lower right hand corner 53 was inserted into card receiving means 26. Once item 46 or 47 is read a closed circuit will be established as described above for items 44 or 45. Thus indicator light 32 will be energized and the dealer will know that his down card has a value of ten and that he has "21". Had the down card not had a value of ten, light 32 would not be turned on and the game would continue on.

Figure 3:
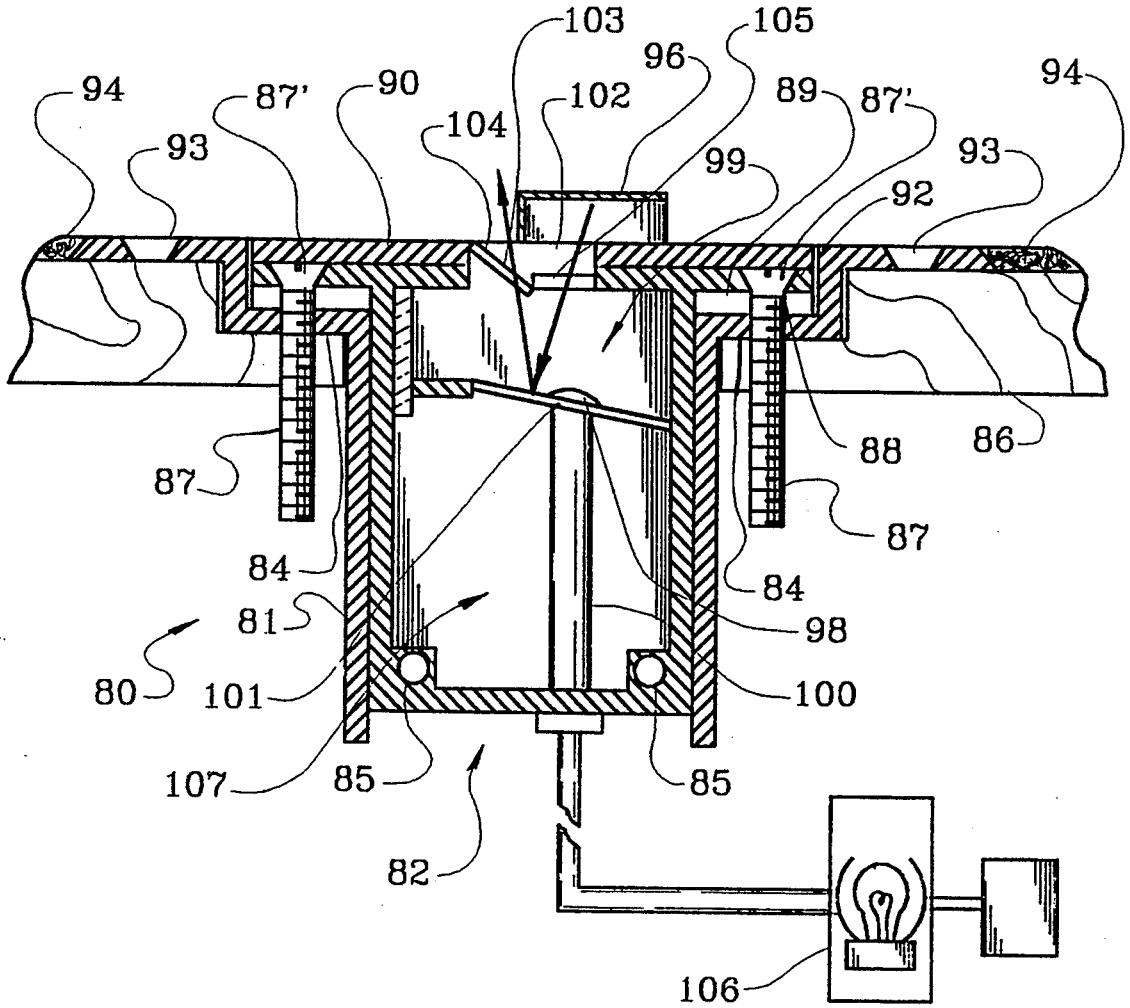
FIG. 3 shows a sectional view of a second embodiment of the instant invention mounted to a blackjack table.
Figure 4:
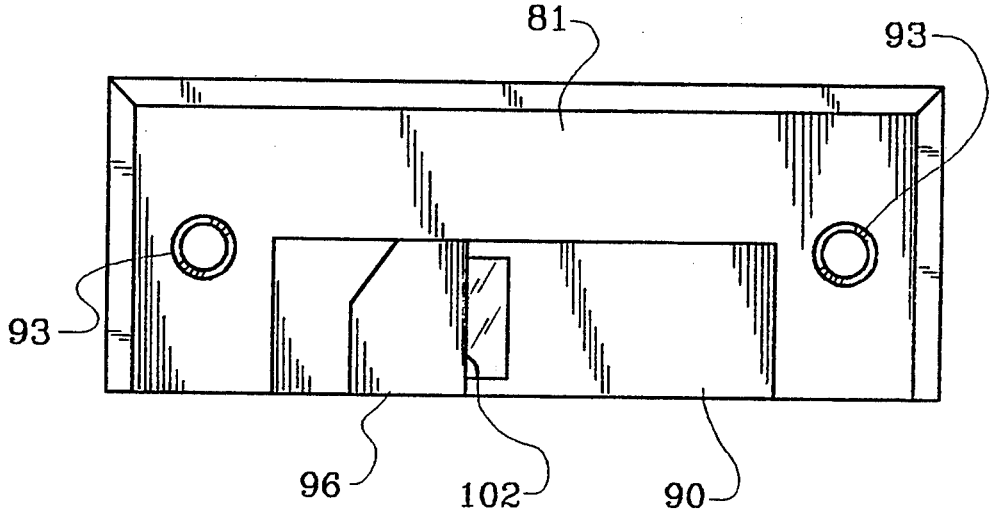
FIG. 4 shows a top plan view of the second embodiment of the instant invention.

As seen in FIG. 3, an alternative embodiment of the instant invention generally designated by the reference numeral 80 is shown. A housing generally designated by the reference numeral 82 is adapted to be connected in recess 84 of a case 81 by conventional attachment means, such as threaded bolts 87 passed through apertures 88 of recess 84. Case 81 is adapted to be connected to a conventional blackjack table 86 by conventional attachment means (not shown), such as by countersunk screws (not shown) passed through apertures 93 defined by the horizontal upper surface of case 81. Housing 82 is comprised generally of a hollow rectangular portion integrally connected to an upper planar portion 89. The upper planar portion 89 is adapted to receive a top surface panel 90. Top surface 90 is connected to upper planar portion 89 in co-planar association. A card receiving means 96 is connected to top surface 90.

As it is preferred that the top surface 90 form a smooth surface so as not to mar any of the playing cards which will come into contact therewith, the connection of the top surface 90 to upper planar portion 89 should be concealed. To this end, the threaded bolts 87 are passed through apertures 92 in upper planar portion 89 and downwardly through corresponding apertures 88 defined by recess 84 of case 81. Top surface 90 may then be laminated to upper planar portion 89 to conceal the heads 87' of bolts 87. The instant invention 80 disclosed herein is intended to fit in generally co-planar arrangement with the covering material 94 of conventional blackjack table 86.

Figure 5:
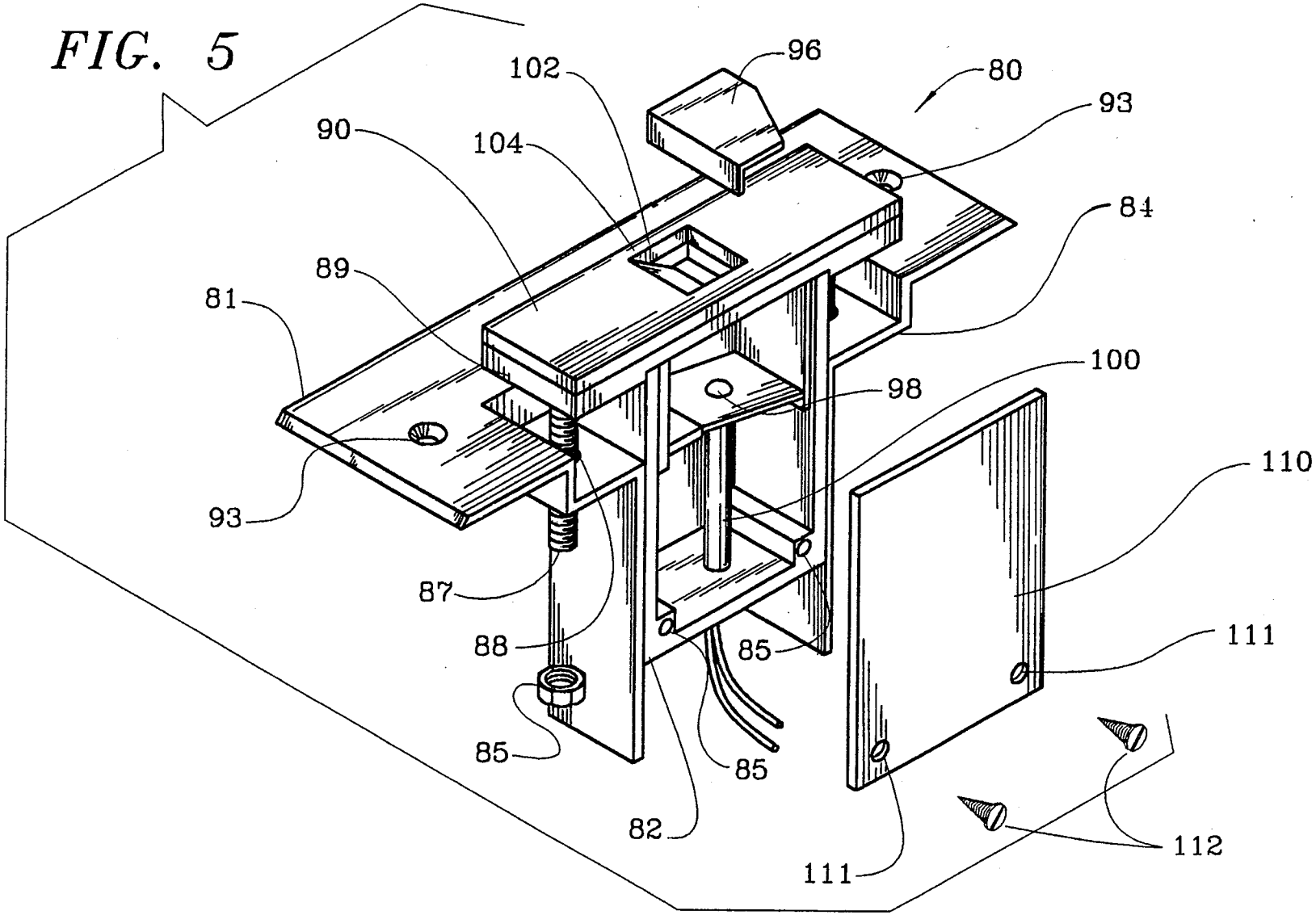
FIG. 5 shows a perspective exploded view of the second embodiment of the instant invention.

As seen in FIG. 3, an aperture 102 is defined by top surface 90 and upper planar portion 89. A card receiving device 96 is connected to top surface 90. Card receiving device 96 is positioned on top surface 90, to allow the face side of the corner being inserted into card receiving device 96 to be placed over a portion of aperture 102. As seen in FIG. 5, the card receiving means 96 is a hood-like member. However, card receiving means 96 is not limited to a hood and can be of any device which will position the face side of the inserted corner over a portion of aperture 102. The hood can have two vertical side walls.

A means for reading a portion of a playing card in the form of a card reading device generally designated by the reference numeral 99 is seen in FIG. 3. Card reading device 99 is comprised of a first, angled transparent segment 103, a second horizontal transparent segment 105 and a reflective surface 101. Preferably reflective surface 101 will be a mirror, however, any surface which will reflect the image in the corner of the playing card inserted can be utilized. The angle in first segment 103 results in a reduced glare off of the outwardly facing surface thereof, enhancing the reader's readability of the reflected image of the corner of the playing card being read. However, segments 103 and 105 may be joined as a one-piece co-planar window member if desired without departing from the scope and spirit of the invention.

In order to produce the reflecting image, reflective surface 101 is disposed below first angled segment 103 and second horizontal segment 105 and supported in position such that when a corner of the down card is inserted under card receiving device 96 and thereby over aperture 102, any indicia thereon will be reflected off of reflective surface 101 and through first angled segment 103. Thus, if the dealer's up card has a value of ten, he visually can determine whether the down card is an Ace or other than an Ace. Alternatively, the dealer can determine whether or not his down card has a value of ten or not, if his up card is an Ace.

To assist the dealer in reading the card under consideration clearly and easily, a light source generally designated by the reference numeral 107 is provided. As seen in FIG. 3, light source 107 may be comprised of fiber optic light lens 98 and conduit 100. Conduit 100 may be comprised of a bundle of fibers (not shown) or a single fiber as known in the art. Conduit 100 extends through an aperture in the bottom of housing 82 and through an aperture in reflective surface 101 and is connected to fiber optic light lens 98 at one end. The other end of conduit 100 extending through the aperture in the bottom of housing 82 will receive light transmission from any ordinary lighting device, such as light bulb 106. The light is transmitted through the conduit 100 to fiber optic light lens 98. Thus, the card reading area 99 will be illuminated and the dealer can more easily and clearly determine if his down card is the card he desires. A single light bulb 106 can be used for each blackjack table 86. Alternatively, conduit 100 of the instant invention 80, for each blackjack table in the casino, may be connected to a single light bulb. Thus, a single light bulb may be used to illuminate the card reading area 99 of each card reader 80 for an entire casino, greatly reducing maintenance requirements.

As shown in FIG. 5, the housing 82 is preferably provided with a removable panel member 110 to allow access to the inside of housing 82. The removable panel member 110 may be secured to housing 82 by any convenient means such as screws 112.

The device is used as follows: After the initial deal of a hand of blackjack, the dealer and all players each have one face up card and one face down card before the remainder of the hand is dealt to the players. If the dealer's face up card is an Ace or has a value of ten, it is desirous to ascertain the value of the dealer's down card before the remainder of the hand is dealt to the players. If his face up card has a value of ten and the dealer's down card is an Ace, the hand can be called because the house wins, and no further time need transpire before a new hand is dealt. To ascertain whether or not the dealer's down card is an Ace, it is placed face down on top surface 90 and either the upper right hand corner 51 or the lower left hand corner 52 of the card, when viewed from the perspective of the playing face of the card, is inserted into card reading means 96. Due to the position of card receiving means 96 on top surface 90, the inserted corner will be placed over a portion of aperture 102. Light source 107 will illuminate card reading area 99, thus enabling the dealer to inspect the underside of the corner of the down card being read for a marking or indicia as the corner of the down card inserted in the card receiving device 96 is reflected off of reflective surface 101. If no marking or indicia is shown, the card is other than an Ace and the hand continues. If the inserted corner shows a marking or other indicia, the dealer immediately knows that the down card is an Ace and that the dealer has twenty-one, at which time the hand can be terminated.

Alternatively, if the dealer's face up card is an Ace and his down card has a value of ten, the hand can be called because the house wins, and no further time need be wasted. To ascertain whether or not the dealer's down card has a value of ten, the dealer's down card will be inserted into card receiving device 96 in a similar manner as described above for determining if the down card is an Ace. However when ascertaining whether the down card has a value of ten, either upper left hand corner 50 or lower right hand corner 53, instead of corner 51 or 52, when viewed from the perspective of the playing face of the card, will be inserted into card receiving device 96. As described above, the dealer will then ascertain whether his down card has a value of ten. If no marking or indicia is shown, the card is other than a ten value card and the hand continues. If the inserted corner shows a marking or other indicia, the dealer immediately knows that the down card has a value of ten and that the dealer has twenty-one, at which time the hand can be terminated.

Figure 7:
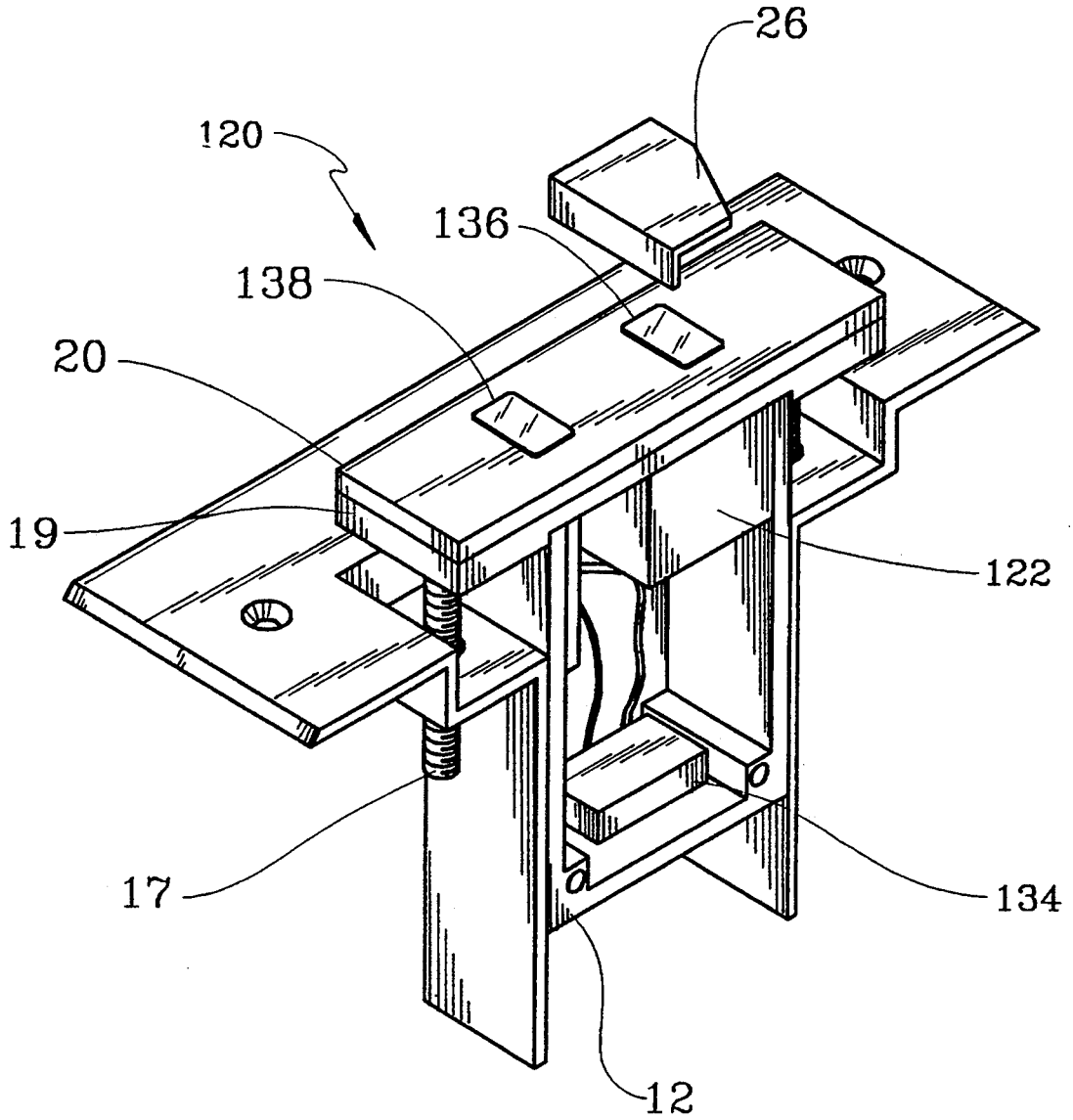
FIG. 7 shows a perspective exploded view of a third embodiment of the instant invention.

A third embodiment of the instant invention is shown in FIG. 7 and generally designated by the reference numeral 120. The specialized playing card is inserted into card reading device 26 causing the corner to be read to be placed over aperture 136. However, a camera unit 122 is utilized to transfer an image of the corner inserted into card receiving device 26. The image will then be transferred to a video monitor 138 for reading by the dealer. An energy source 134 will supply power to camera unit 122 and video monitor 138. Though energy source 134 is shown within housing 12, it is to be understood that energy source 134 can be external to housing 12.

Figure 8:
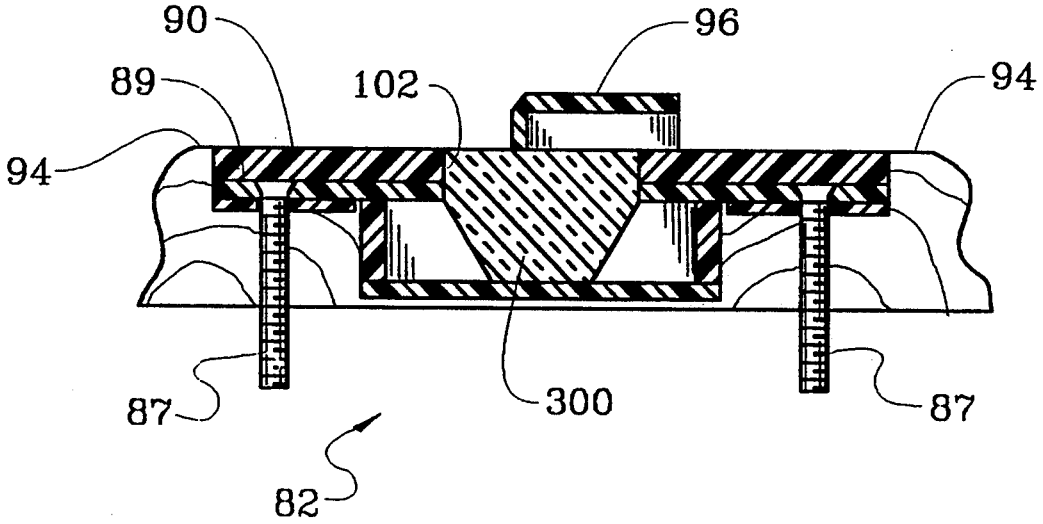
FIG. 8 shows a side cross sectional view of a fourth embodiment of the invention.
Figure 9:
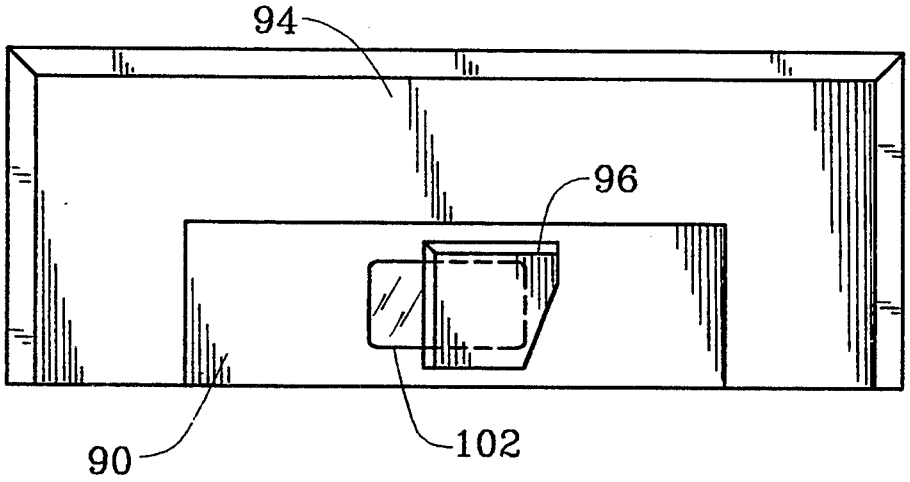
FIG. 9 shows a top view of the fourth embodiment of the invention.
Figure 10:
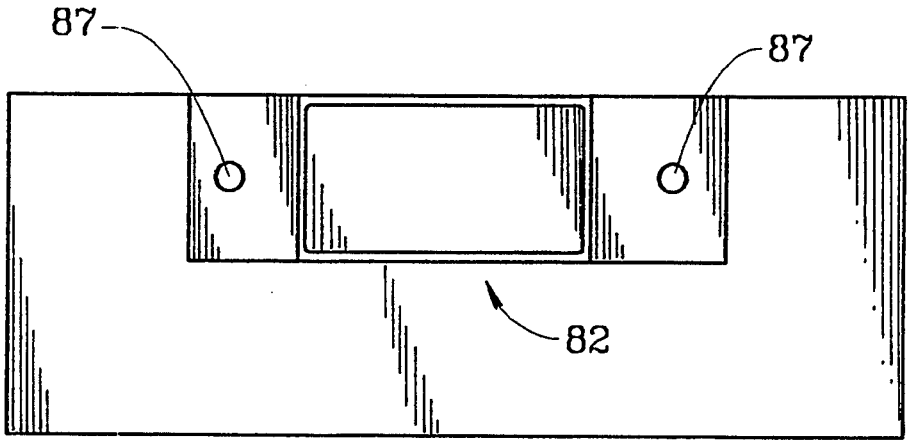
FIG. 10 shows a bottom view of the fourth embodiment of the invention.
Figure 11:
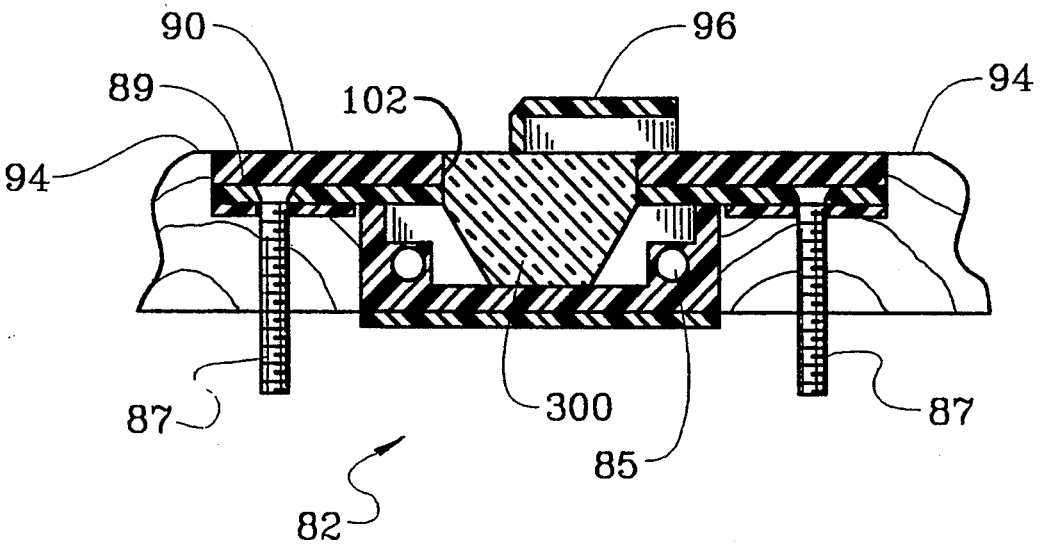
FIG. 11 shows a side cross sectional view of a slightly modified version of the fourth embodiment of the invention, including a removable side cover.
Figure 12:
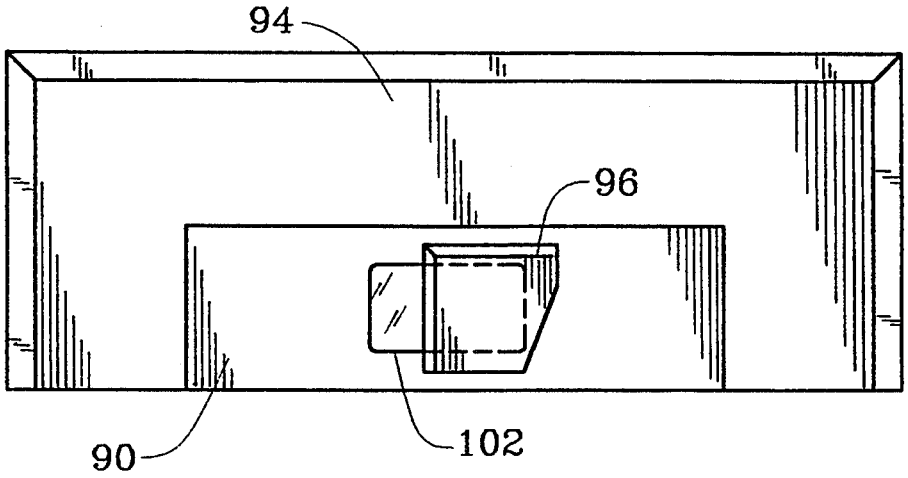
FIG. 12 shows a top view of the slightly modified version of the fourth embodiment of the invention.
Figure 13:
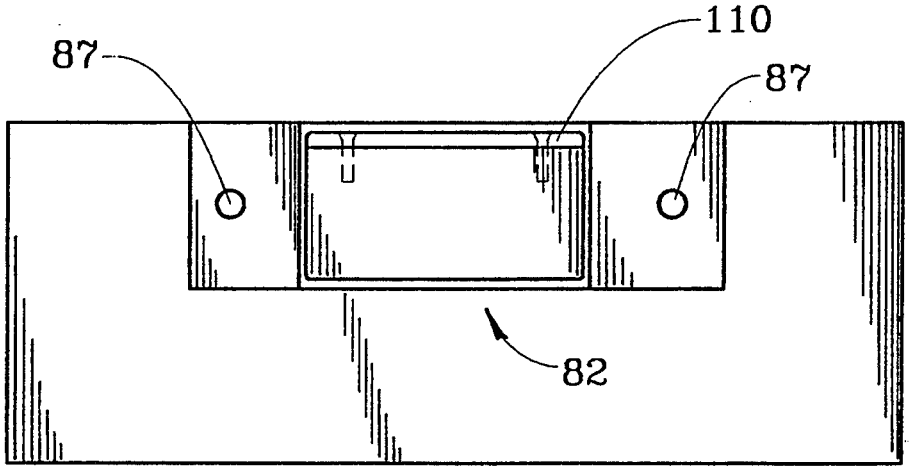
FIG. 13 shows a bottom view of the slightly modified version of the fourth embodiment of the invention.

A fourth embodiment of the instant invention is shown in FIGS. 8–10, and a slightly modified version having a removable side cover 110 is shown in FIGS. 11–13. The fourth embodiment is somewhat similar to the second embodiment described above (the same reference numerals are used to denote the same parts of the second and fourth embodiments) except that the reflective card reading device 99 is replaced by a refractive device 300 (e.g., a prism(s)) for transferring the image of a corner of the card through the refractive device and the aperture 102 to be viewed by the blackjack dealer. Reference numeral 82 generally indicates the prism housing which is sealed in FIGS. 8–10 and includes a removable cover in FIGS. 11–13. In all of FIGS. 8–13, reference numeral 102 indicates the aperture, 96 the card receiving device or hood, 90 the top surface panel, 89 the upper planar portion, and 87 the threaded bolts for securing the device to the covering material 94 of the blackjack table. In FIG. 11, reference numeral 85 indicates the female threaded bolt holes for securing the removable side cover 110 to protectively close the housing 82 of the device.

Although only one prism is shown in FIGS. 8–13, more than one prism may be employed. Further, the prism(s) may be shaped differently than that shown in FIGS. 8–13 so long as the image of the corner of the card is refracted towards the blackjack dealer.

FIGS. 9 and 12 are top views of the device according to the fourth embodiment and the modified device having a removable side panel, respectively. The dotted lines are drawn to indicate the shape and position of the aperture 102 beneath the card receiving hood 96.

FIG. 10 is a bottom view of the device according to the fourth embodiment (having a sealed prism housing).

The threaded bolts are indicated by reference numeral 87 and the sealed housing by reference numeral 82.

FIG. 13 is a bottom view of the slightly modified device of the fourth embodiment. The removable side cover is indicated by reference numeral 110, and the dotted lines are drawn to show the female threaded bolt holes 85 in which bolts (not shown) are inserted to secure the removable side cover 110 to the housing 82.

Thus, the fourth embodiment differs from the second embodiment primarily in that the fourth embodiment employs a refractive element for refracting an image of the corner of the playing card towards the dealer, whereas the second embodiment employs a reflective element for reflecting an image of the corner of the playing card towards the dealer.

The instant invention has been shown and described herein in what are considered to be the most practical and preferred embodiments. While the principles of this invention have been described in connection with the specific apparatus, it is to be clearly understood that this description is made only by way of example and not as a limitation to the scope of the invention. It is recognized, however, that departures may be made therefrom within the scope of the invention and that obvious modifications will occur to a person skilled in the art.

What I claim is:

1. A device for reading a face down card on a blackjack table in a game of blackjack, comprising:

a blackjack table; and a refractive element positioned beneath a top surface of the blackjack table and beneath the face down card for refracting an image of the face down card towards a dealer to be viewed by the dealer.

2. A device as recited in claim 1, wherein said refractive element comprises one or more prisms.

3. A device as recited in claim 1, further comprising a card receiving element for receiving the portion of each down card.

4. A device as recited in claim 3, wherein said card receiving element comprises a hood connected to a top surface of said top planar member.

5. A device for reading a portion of each down card of a deck of specialized playing cards in a game of blackjack, comprising:

a housing comprising a top planar member and an aperture extending through said top planar member; and a refractive element positioned within said housing for refracting an image of the portion of each down card through said aperture to be viewed by a dealer.

6. A device as recited in claim 2, wherein said refractive element comprises one or more prisms.

7. A device as recited in claim 5, further comprising a card receiving element for receiving the portion of each down card.

8. A device as recited in claim 7, wherein said card receiving element comprises a hood.

9. A device as recited in claim 5, wherein said housing is a sealed compartment.

10. A device as recited in claim 5, wherein said housing has a removable side panel for accessing said refractive element.

11. A device for reading a portion of a specialized playing card in a game of blackjack, comprising:

a housing connected to an upper member, said upper member defining a top surface, said top surface defining a card reading aperture over which a portion of a specialized playing card is positioned; and a refracting means located within said housing for refracting an image of the portion of the specialized playing card towards a blackjack dealer to inform the dealer of the presence or absence of a blackjack pair.

12. A device for reading a portion of each card of a deck of specialized playing cards in a game of blackjack, comprising:

a housing having a top planar member defining a top planar surface; and a refracting means located within said housing for refracting an image of the specialized playing card while the playing card is disposed face down on a blackjack table and on the top planar surface.

13. A device for reading a portion of a specialized playing card in a game of blackjack to indicate to a dealer that he has been dealt "21", comprising:

a housing, said housing including an upper member which defines an upper surface and an aperture; and a refracting means positioned within said housing for refracting an image of the portion of the specialized playing card towards the dealer to be viewed by the dealer.

* * * * *